US006155669A

United States Patent [19]

Donahue et al.

[11] Patent Number: 6,155,669

[45] Date of Patent: Dec. 5, 2000

[54] PAGEWIDTH INK JET PRINTER INCLUDING A PRINTBAR MOUNTED ENCODING SYSTEM

[75] Inventors: Frederick A. Donahue, Walworth; David G. Anderson, Ontario, both of N.Y.

[73] Assignee: Xerox Corporation, Stamford, Conn.

[21] Appl. No.: 09/004,763

[22] Filed: Jan. 8, 1998

[51] Int. Cl.[7] ..... B41J 2/155

[52] U.S. Cl. ..... 347/42; 347/139

[58] Field of Search ..... 347/42, 13, 37, 347/116, 139, 153, 154, 164, 177, 229, 234, 248

[56] References Cited

U.S. PATENT DOCUMENTS

| | | | |
|---|---|---|---|
| 4,912,491 | 3/1990 | Hoshino et al. | 347/116 |
| 5,040,003 | 8/1991 | Willis | 347/118 |
| 5,220,346 | 6/1993 | Carreira et al. | 347/102 |
| 5,394,223 | 2/1995 | Hart et al. | 355/212 |

*Primary Examiner*—N. Le
*Assistant Examiner*—Lamson D. Nguyen
*Attorney, Agent, or Firm*—Linda M. Robb

[57] ABSTRACT

A liquid ink printer, depositing liquid ink to form an image, on a recording medium, including a printing dimension defining a maximum print area to receive the liquid ink, moving along a recording medium path. The printer includes a printbar, including a plurality of nozzles, aligned substantially perpendicular to the recording medium path, to deposit a swath of ink on the recording medium during movement of the recording medium along the recording medium path, a recording medium transport, disposed adjacent the plurality of nozzles, to move the recording medium along the recording medium path, and an encoder system, spaced from the recording medium transport, to determine the position of the recording medium transport with respect to the array of nozzles. The printbar includes a mounting substrate to mount a plurality of printhead dies including the nozzles and an optical reader of the encoder system. The nozzles and optical reader are aligned and the encoder system accurately determines the position of a belt of the recording medium transport with respect to the nozzles.

22 Claims, 6 Drawing Sheets

PAGEWIDTH INK JET PRINTER INCLUDING A PRINTBAR MOUNTED ENCODING SYSTEM

FIELD OF THE INVENTION

This invention relates generally pagewidth ink jet printer and more particularly to a belt encoding system including a printbar mounted encoding system.

BACKGROUND OF THE INVENTION

Liquid ink printers of the type frequently referred to as continuous stream or as drop-on-demand, such as piezoelectric, acoustic, phase change wax-based or thermal, have at least one printhead from which droplets of ink are directed towards a recording medium. Within the printhead, the ink is contained in a plurality of channels. Power pulses cause the droplets of ink to be expelled as required from orifices or nozzles at the end of the channels.

In a thermal ink-jet printer, the power pulses are usually produced by resistors each located in each one of the respective channels and individually addressable by current pulses to heat and vaporize ink in the channels. A thermal energy generator, usually a resistor or a heater, is located in each of the channels, a predetermined distance from the nozzles. The resistors are electrically individually addressed with a current pulse to momentarily vaporize the ink thereby forming a bubble which expels an ink droplet. As the bubble grows, the ink which bulges from the nozzles, is contained by the surface tension of the ink as a meniscus. As the bubble begins to collapse, the ink remaining in the channel between the nozzle and the bubble move towards the collapsing bubble causing a volumetric contraction of the ink at the nozzle resulting in the separation of the bulging ink as a droplet. The acceleration of the ink out of the nozzle while the bubble is growing provides the momentum and velocity of the droplet in a substantially straight line direction towards the recording medium. The droplet of ink lands on the recording medium and forms an ink spot. Because the droplet of ink is emitted only when the resistor is actuated, this type of ink jet printing is known as drop-on-demand printing. The channel is then refilled with ink by capillary action, which, in turn, draws ink from a supply container. Operation of a thermal ink-jet printer is described in, for example, U.S. Pat. No. 4,849,774.

One particular form of ink jet printer is described in U.S. Pat. No. 4,638,337. The described printer is of the carriage type and has a plurality of printheads each having its own supply cartridge mounted on a reciprocating carriage. The nozzles in each printhead are aligned perpendicularly to the line of movement of the carriage and a swath of information is printed on the stationary recording medium as the carriage is moved in one direction. The recording medium is then stepped perpendicularly to the line of carriage movement by a distance equal to the width of the printed swath. The carriage is then moved in the reverse direction to print another swath of information. Full width or page width linear arrays in which the sheet is moved past a linear array of nozzles extending across the full width of the sheet, are also known.

In a typical ink-jet printing machine, the carriage must transport the printhead assembly across the page for printing and must also move the carriage to predetermined locations for capping, priming, and other maintenance functions for the printhead and the printhead nozzles thereof. In each of these instances, the carriage is moved across the recording medium in a controlled fashion or is parked at the predetermined locations along the carriage rails. A carriage motor and electronic controller are provided to precisely position the carriage at these locations. Since a motor is typically used, the rotary motion of the motor, is converted to the linear motion of the carriage by among others, a toothed belt/pulley, a cable/capstan or a lead screw. In addition to these devices, which move the carriage in a linear fashion, the linear motion is controlled and/or kept track of by an encoder.

Linear and rotary encoders are used for positioning and timing of movable members. In linear encoders, a linear strip of material includes a plurality of markings called fiducial markings, which are typically illuminated by a source of light and detected by an optical sensor to determine positioning and timing. The optical sensor detects the fiducial markings and generates a series of electrical pulses which are transmitted to a control system for controlling the motion of a movable member, such as a printhead carriage. The linear strip of fiducial markings is mounted on the printer is parallel to the anticipated path of the carriage as it traverses across the recording medium. The light source and sensor are mounted on the carriage so that as the carriage reciprocates back and forth across the recording medium the combination light source/sensor can illuminate and detect the fiducial markings on the encoder strip for controlling the motion of the printhead carriage.

Rotary encoders use a disk coupled to a rotating member in which the disk includes a plurality of spaced marks. The marks are arranged on the disk so that as the marks rotate with the rotating member an illumination source/sensor senses the marks for determining the position, velocity and acceleration the rotating member. The illuminating source and the sensor can be disposed on opposite sides of the rotating disk to sense the passage of marks if the disk is transparent to light. In this way, a pulse is generated for each increment between adjacent marks of the disk.

In both the linear strip and disk encoders, the fiducial markings are typically spaced a predetermined distance apart related to a printing resolution for controlling the motion of the moving member. These fiducial marks are typically produced via a photographic or etching process. Once the strip or disk has been made, the encoder strip or disk is mounted on a support member such as a stationary platform, as in the case of monitoring the position of a printhead carriage, or a moving platform when the disk is mounted on the rotating member. Because it is desirable to accurately control the motion and/or position of the moving member, accurate placement of the encoder strip or disk is critical. Consequently, the encoder strip or disk must be positioned accurately on the support member or the member which is to be controlled. Typically, the positioning of the strip or disk must be made to a fairly tight tolerance to assure accurate control of the moving member.

Various printers and methods are illustrated and described in the following disclosures which may be relevant to certain aspects of the present invention.

In U.S. Pat. No. 5,394,223 to Hart et al., an apparatus for image registration is described. The apparatus positionally tracks a moving photo conductive belt and adjusts an imager in an electrophotographic printing machine to correct for alignment errors when forming a composite image. Registration errors are sensed by developing an appropriate set of target marks, detecting the target marks and controlling the position of the imager.

SUMMARY OF THE INVENTION

In accordance with one aspect of the present invention, there is provided a liquid ink printer, depositing liquid ink to form an image, on a recording medium, including a printing dimension defining a maximum print area to receive the liquid ink, moving along a recording medium path. The printer includes a printbar, including a plurality of nozzles, aligned substantially perpendicular to the recording medium path, to deposit a swath of ink on the recording medium during movement of the recording medium along the recording medium path, a recording medium transport, disposed adjacent the plurality of nozzles, to move the recording medium along the recording medium path, and an encoder system, spaced from the recording medium transport, to determine the position of the recording medium transport with respect to the array of nozzles.

BRIEF DESCRIPTION OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
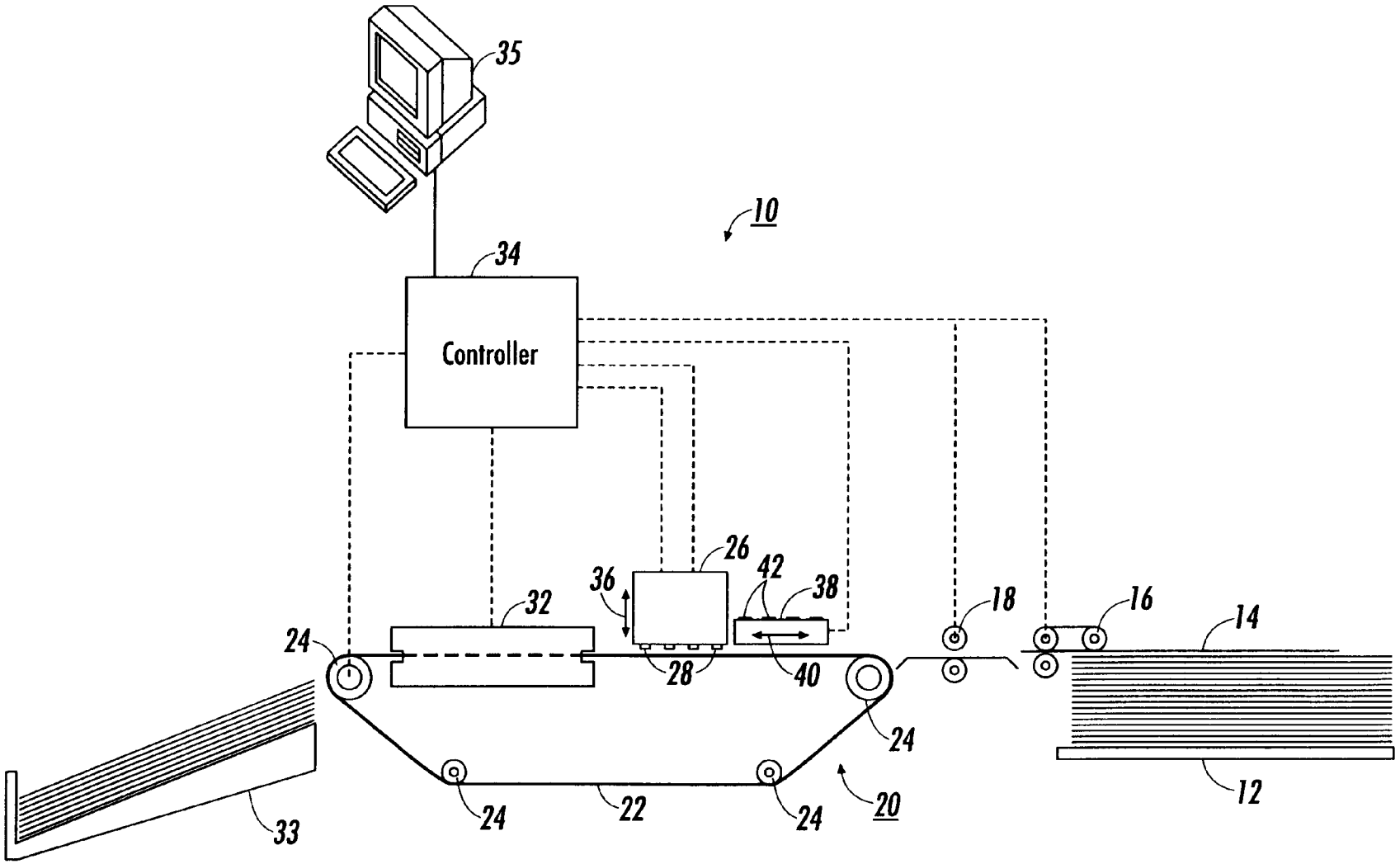
FIG. 1 is a schematic elevational view of an ink jet printer.

FIG. 1 illustrates a schematic elevational view of a liquid ink printer 10, for instance, an ink jet printer. The liquid ink printer 10 includes an input tray 12 containing sheets of a recording medium 14 to be printed upon by the printer 10. Single sheets of the recording medium 14 are removed from the input tray 12 by a pickup roller 16 and fed by feed rollers 18 to a transport mechanism 20. The transport mechanism 20 moves the sheet by a feed belt or belts 22 driven by rollers 24 beneath a liquid ink printbar assembly 26. The belt 22 can include a plurality of apertures through which a vacuum is applied with a vacuum applicator(not shown) to hold the sheet to the belt. The belt can also be an electrostatic belt by which the sheet is held electrostatically. The printbar assembly 26 includes one or more pagewidth printbars 28 supported in a printing position by a printhead support (not shown) in a confronting relation with the belt 22. During printing, the pagewidth printbars 28 deposit liquid ink on the recording medium 14 as it is carried by the belt 22 beneath the plurality of printbars 28. Each of the pagewidth printbars 28 includes an array of print nozzles, for instance, staggered or linear arrays, having a length sufficient to deposit ink in a printzone across the width of the recording medium 14. Such an array can be formed according to the techniques described, for example, in U.S. Pat. No. 5,221,397 the contents of which are hereby incorporated by reference. The printbar assembly 26 also includes an ink supply either attached to the printhead support or coupled to the pagewidth printheads through appropriate supply tubing.

The recording medium 14 is then carried by the belt 22 through a dryer 32 for drying the liquid ink thereon. The dryer 32 can be a microwave dryer or other known types of dryers generating sufficient heat energy to dry the liquid ink which has been deposited upon the recording medium 14. If, however, the dryer 32 is a microwave dryer, the belt 22 is preferably made of a material substantially transparent to microwave power and having a relatively low dielectric constant. After the sheet is substantially dry, the sheet is deposited in an output tray 33.

If the dryer 32 is a microwave dryer, ink specially formulated to be heated by microwave power is preferably used. Such ink may include compounds designed to couple with the microwave power for increasing the amount of heat conducted thereby. One such compound is an ionic compound at least partially ionizable in the liquid vehicle. U.S. Pat. No. 5,220,346, entitled "Printing Processes with Microwave Drying", assigned to Xerox Corporation, discloses a suitable ink.

A controller 34 controls the operation of the transport mechanism 20, which includes the pickup roller 16, the feed roller 18 and the drive rollers 24. In addition, the controller 34 controls the movement of the printbar assembly 26, printing by the printbars 28, and operation of the dryer 32, as would be understood by one skilled in the art. The controller 34 can also include a plurality of individual controllers, such as microprocessors or other known devices dedicated to perform a particular function. An image input device 35, such as a personal computer, transmits image information to the controller 34.

At the completion of a printing operation or when otherwise necessary, such as during a power failure, the printbar assembly 26, which is movable in the directions of an arrow 36, is moved away from the belt 22 such that a capping assembly 38, movable in the directions of the arrow 40, is moved beneath the printbar assembly 26 for capping thereof. Once the cap assembly 38 is positioned directly beneath the printbar assembly 26, the printbar assembly 26 is moved towards the belt 22 and into contact with a plurality of capping gaskets 42 located on the cap assembly 38.

The cap assembly 38 includes one or more of the capping gaskets 42 which engage or contact the page width printbars on an area surrounding one or more of the printbars to thereby seal the printbar nozzles from exposure to air. Suitable capping elements include those described later herein or those which compress to make a satisfactory seal. This substantially airtight seal prevents the ink contained in the nozzles from drying out to thereby prevent clogging of the individual printbar nozzles. U.S. patent application Ser. No. 08/566,472 to Anderson et al. entitled "Fluid Applicator For Maintenance of Liquid Ink Printers", assigned to Xerox Corp., describes a suitable capping element and a cleaning system including a wetting device and a vacuum device, and is herein incorporated by reference. Once a capping operation is complete, the printbar assembly 26 moves away from the belt 22 and the cap assembly 38 moves away from the printbar assembly 26 such that the printbar assembly 26 can be positioned appropriately with respect to the belt 22 for printing on the recording sheets 14. In addition to the cap assembly 38, the ink jet printer 10 includes a maintenance assembly described in the application to Anderson et al. The maintenance assembly includes a wet wiper nozzle for wiping the front face of the printhead assemblies as well as a vacuum wipe which follows the wet wipe nozzle as it moves along the front face to vacuum any contaminants from the front face including dried ink as well as paper fibers.

Figure 2:
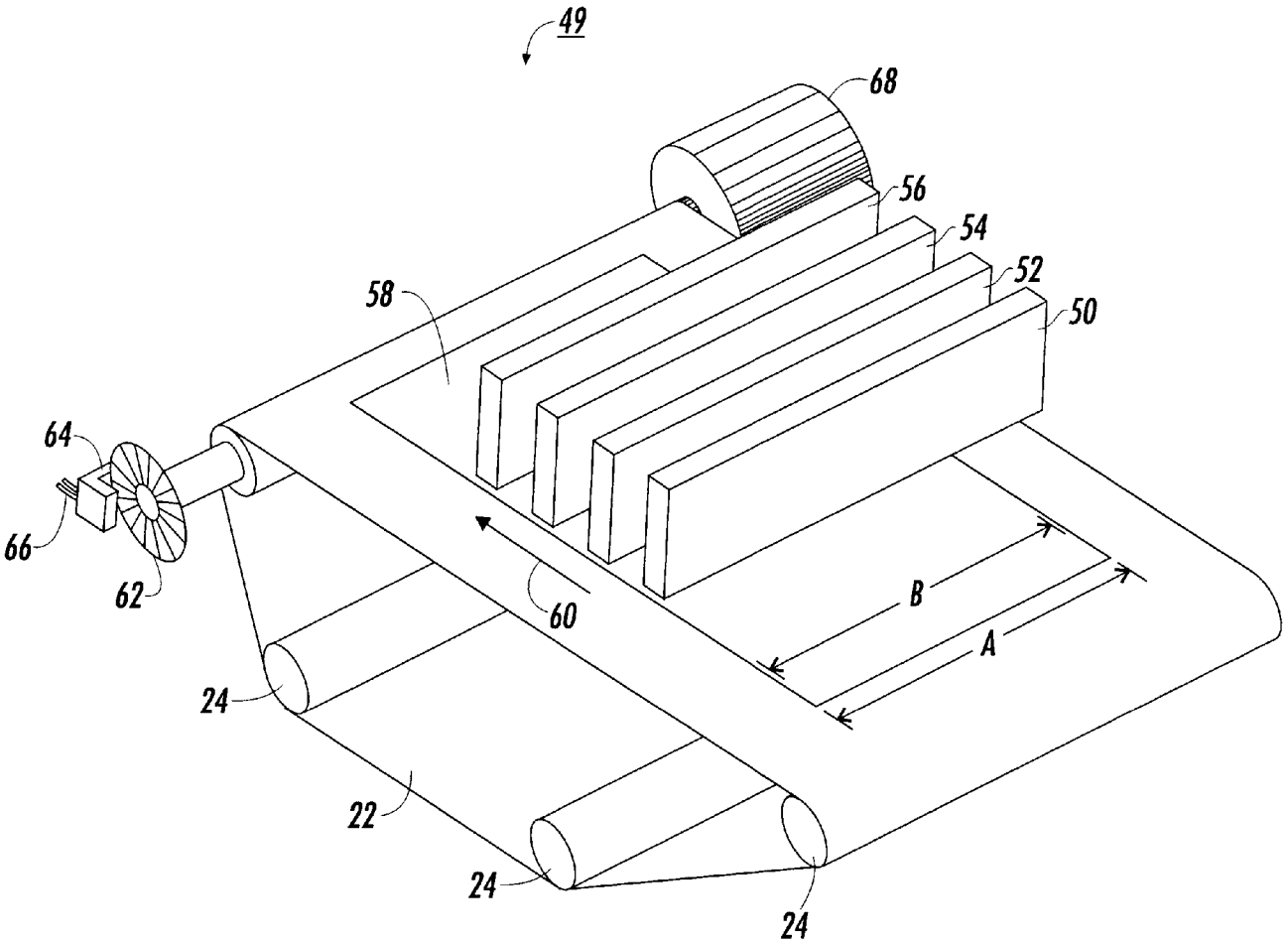
FIG. 2 (Prior Art)
FIG. 2 illustrates a perspective view of an ink jet printer including a rotary encoder.

As illustrated in FIG. 2, in one example of a prior art page width printer, the printer 49 includes a first pagewidth print bar 50, a second pagewidth print bar 52, a third pagewidth print bar 54, and a fourth pagewidth print bar 56. Each of the print bars deposits liquid ink upon a recording medium 58 which has a recording medium width A which is measured perpendicularly to a sheet advance direction 60. Each of the pagewidth print bars includes a length sufficient to deposit a single line of information across the width A. In addition, each of the page width print bars deposits one of a plurality of inks which include cyan, magenta, yellow and black. Since each of the print bars 50, 52, 54, and 56 are fixed in a known position with respect to one another, a rotary encoder 62 enables printing at selected locations on the recording medium 58 to generate an image responsive to pixel information which is transmitted to the printheads through the controller 34. The rotary encoder 62 includes an encoder reader 64 which is coupled to the controller 34 to transmit belt position information to the controller through a cable 66. A motor 68 is used to drive the belt 22 in the direction 60.

While the encoder 62, as illustrated in FIG. 2, can provide adequate information to the controller for depositing the ink at the correct locations on the recording medium 58, this system suffers certain disadvantages including eccentricity errors due to encoder disc to shaft mounting tolerances. The drive rollers 24 can also suffer from run out errors. Both of these disadvantages result in timing errors occurring between the actual belt position beneath the print bars and the encoder fiducial marks. In a print-on-demand system such as a thermal ink jet printer, such errors show up as banding, or hue shifts in a color system. The distance between print bars is determined by counting the encoder clock ticks between bars. Such a system, therefore, not only suffers from inaccuracies of the rotary encoder, the encoder reader, but can also suffer from the certain inaccuracies resulting from counting encoder clock ticks between bars.

Figure 3:
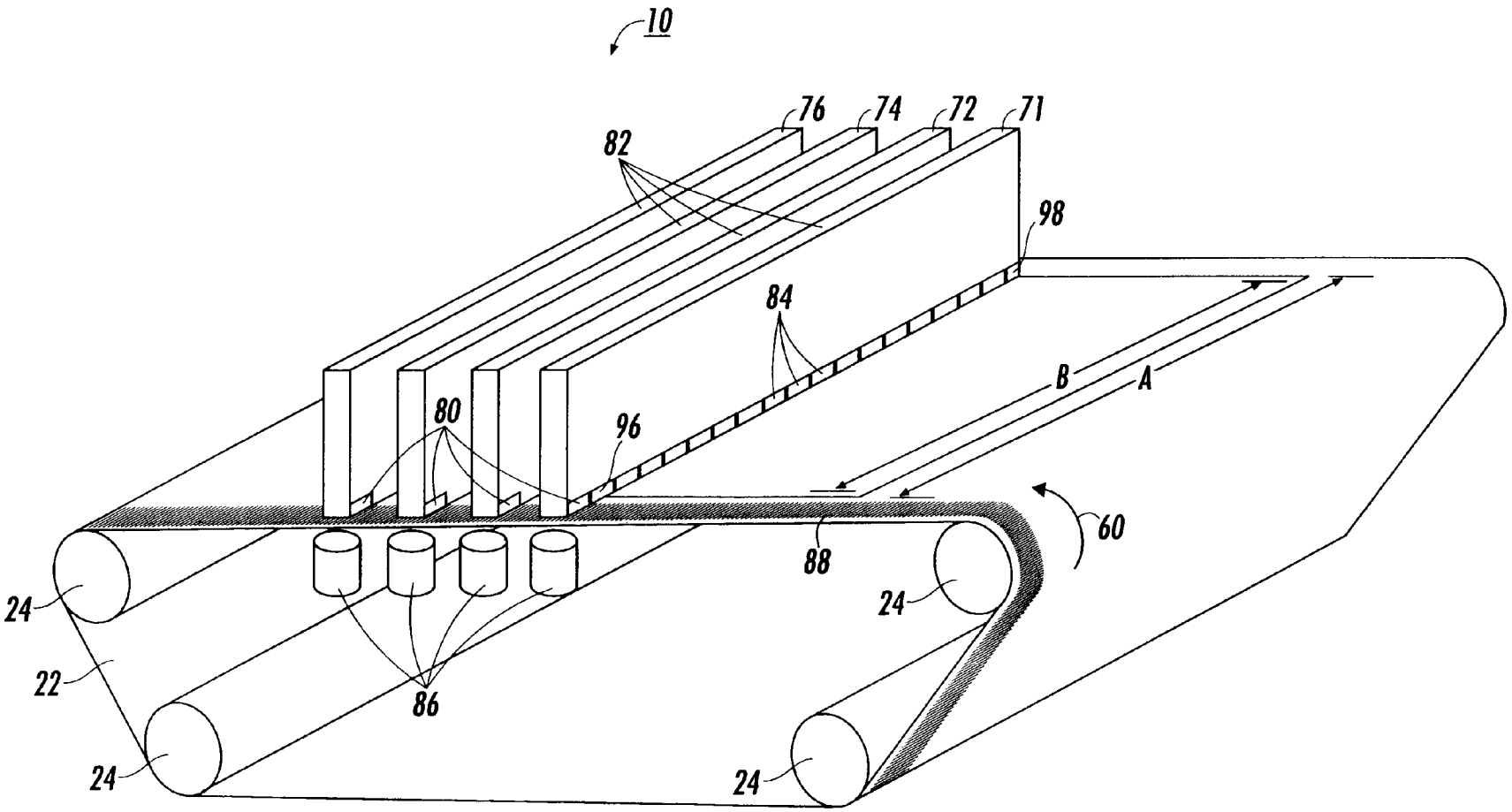
FIG. 3 illustrates a perspective view of an ink jet printer including a belt encoding system and integral readers of the present invention.

The encoder system of the present invention is illustrated in FIG. 3, which shows the printer 10 of the present invention, including a first collinear print bar with an optical reader 71, a second collinear print bar 72, a third collinear print bar 74, and a fourth collinear print bar 76. Each of the print bars includes an optical reader 80 which is attached to one end of each of the print bar support substrates 82. Adjacent to the optical readers 80, on each of the print bars, is a plurality of thermal ink jet printhead dies 84, each of which deposits ink under control of the controller 34 responsive to pixel image data received from the personal computer 35 or other known image input devices.

During printing, each of the optical readers 80 receives light from a respective one of a plurality of light sources 86, the light being transmitted through the belt 22 which is semi-transparent, in one embodiment, at least in the portion of the belt including a plurality of fiducial marks 88. The fiducial marks 88 are located directly on the belt 22 at a pre-determined spacing such that the location of the recording sheet 58 can be accurately determined when passing by each of the print bars. The light sources may be located at another side of the belt than the optical readers or may be located at the same side as the optical readers.

The present invention provides a highly accurate recording system since the fiducial marks are located directly on the belt and the optical readers 80 are mounted directly on the print bar. While a single optical reader could be mounted on a single one of the printbars in a lower cost, less precise printing system, it is preferred that each of the print bars includes an optical reader. By mounting each of the individual readers on a print bar, such that the print bar is an integral reader/die print bar, the registration requirements necessary in mounting the print bars in such a system are relaxed since a unique encoder timing signal can be generated for each bar.

Figure 4:
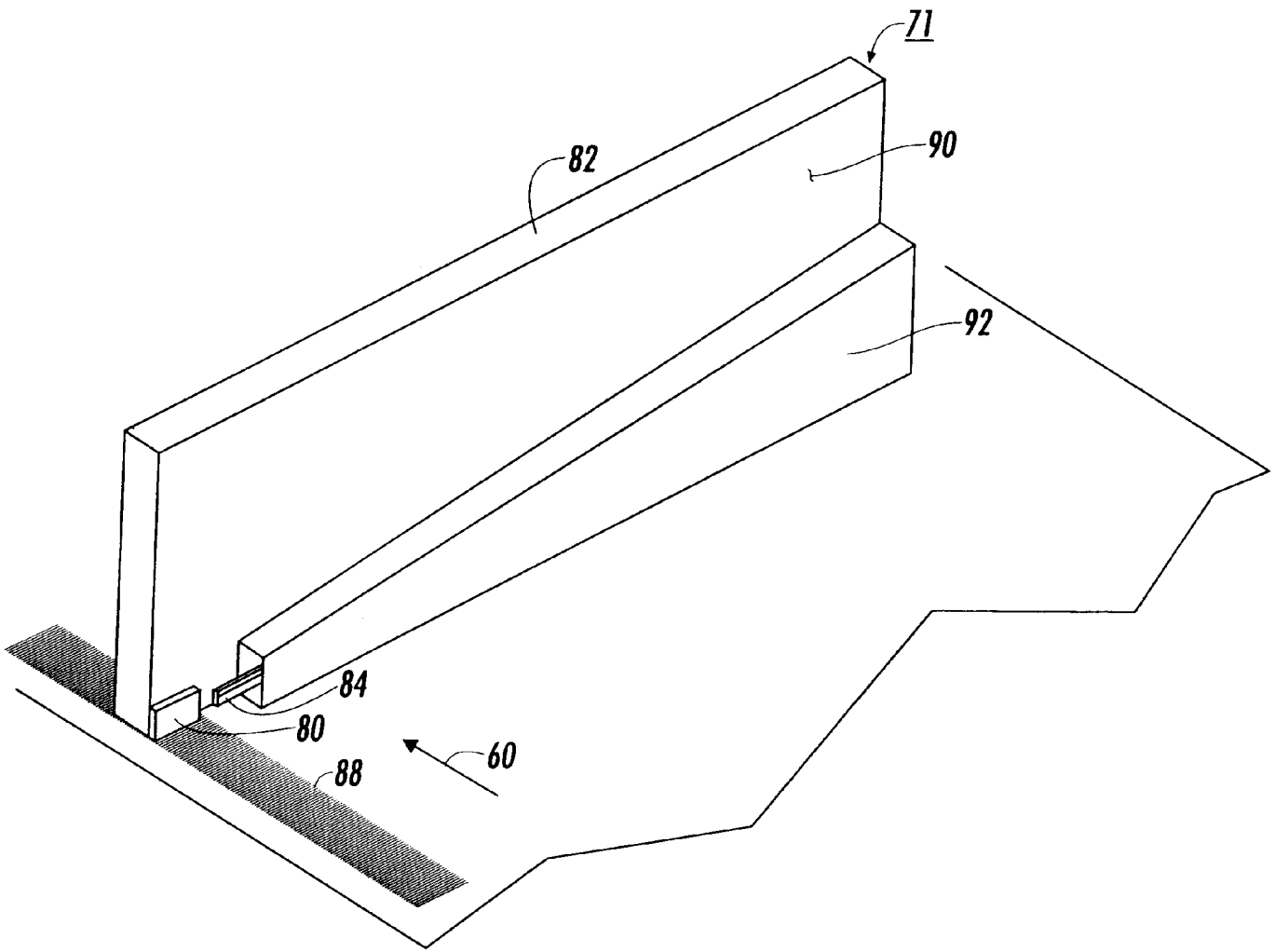
FIG. 4 illustrates a single pagewidth print bar of the present invention including an optical reader.

FIG. 4 illustrates the print bar 71 including the substrate 82 which acts as a heat sink as well as a substantially planar mounting surface for mounting of the thermal ink jet printhead dies 84 and the optical reader 80. The substrate 82, due to the positional requirements of the printhead dies 84, includes a substantially planar surface at the mounting area of the printhead dies reader such that the mounting surface varies approximately no more than plus or minus 10–15 microns. Consequently, the optical reader 80, which is mounted on a surface 90 of the substrate 82, is properly aligned with the array of ink jet nozzles also mounted thereon. By mounting the optical reader 80 on the same supporting medium as the printhead dies, no calculation is necessary to determine the spacing between an optical reader and the print bars placed apart therefrom in the system. In addition, since each of the substrates 82 includes its own optical reader, each of the print bars generates its own positional signal which is highly accurate.

The optical readers 80 could comprise a simple photodiode, a photo transistor, an amorphous silicon array, including an array of light sensing optical readers, or a charge coupled device (CCD) array. Since the optical readers receive light from the light sources 86, and each of the light sources 86 is dedicated to the generation of a sufficient amount of light for sensing by the readers 80, wider latitude is granted in the selection of the type of light sources which can be used. For instance, if the composition of the belt material is limited due to being selected according to system constraints including to withstand microwave drying in the microwave dryer 32, the light sources 86 can be appropriately selected to generate sufficient light for reading by the optical readers 80. As such, the optical reader/light source combination is not a restrictive design. For instance, each of the light sources 86 can include a halogen lamp. In addition, a single light source may be used to generate light for all of the optical readers.

Each of the print bars includes an ink manifold, such as an ink manifold 92, illustrated in part, for the print bar 71, each of which supplies ink to the associated printhead dies. The ink manifold 92 is typically connected to an ink container which is located away from the print bar by flexible tubing.

Figure 5:
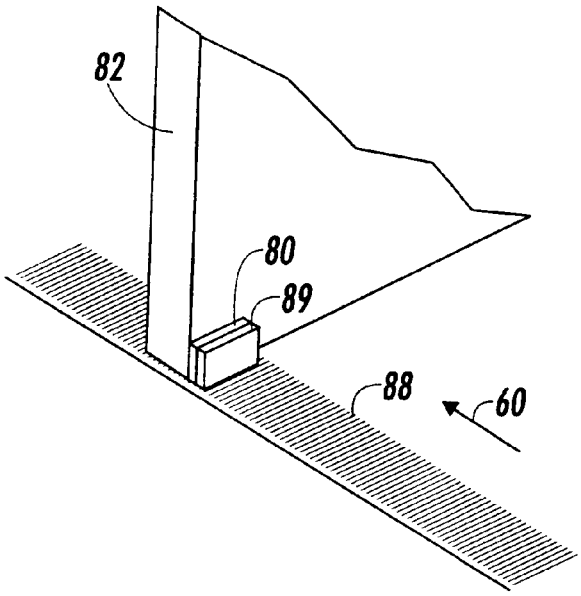
FIG. 5 illustrates one example of a reader/light source of the present invention.
Figure 6:
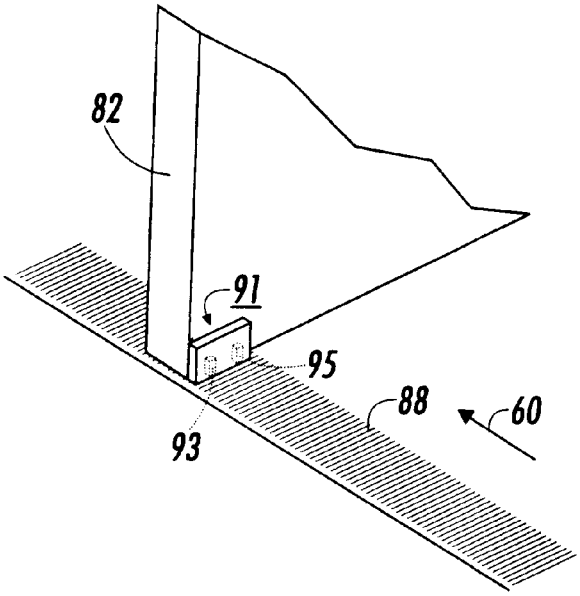
FIG. 6 illustrates another example of a reader/light source of the present invention.

If the belt 22 does not transmit sufficient light for the light sources to be placed on an opposite side of the belt from the readers, a reflective optical reader system can be used as illustrated in FIG. 5 and in FIG. 6. In FIG. 5, for instance, the reader system includes a light source 89 which is coupled to the optical reader 80. The light source 89 directs light towards the belt 22 and the markings 88 where it is reflected back to the reader 80 for the generation of the belt position signals. It is preferred that the reader 80 is located closest to the substrate as illustrated. In a second embodiment as illustrated in FIG. 6, a reflective optical reader system 91 is illustrated which includes a light source 93 and an optical reader 95 in a package attached to the substrate 82. The light source as well as the optical reader may also be single devices each individually mounted to the substrate 82. Light sources include a diode array or an incandescent light source. Emitter/receiver units are also possible.

Figure 7:
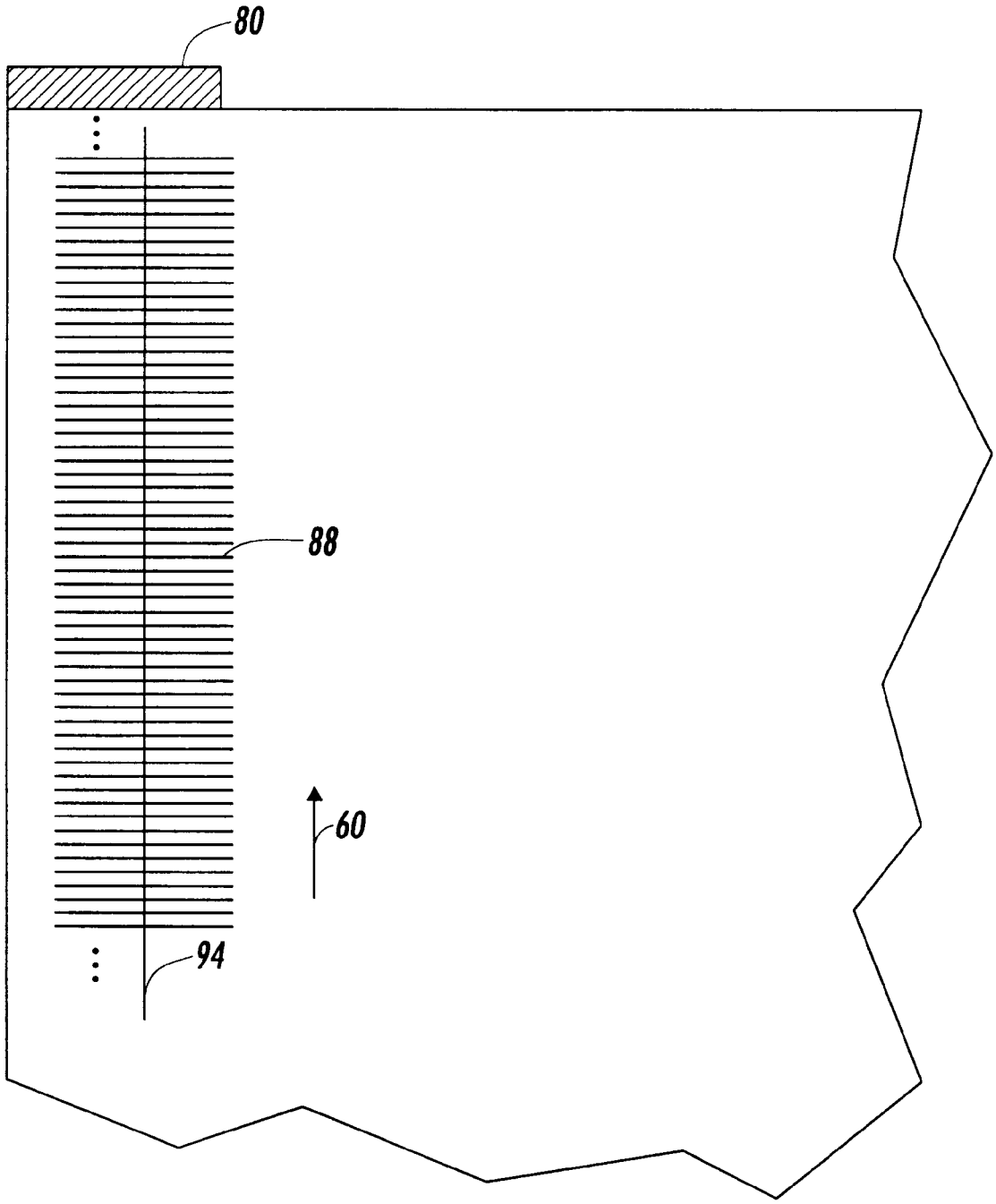
FIG. 7 illustrates one example of a plan view of a belt tracking fiducial marking system.

While the fiducial marks 88 of FIG. 3 and 4 are aligned perpendicularly to the process direction 60, another fiducial mark 94, as illustrated in FIG. 7, can be arranged parallel to the process direction 60, to intersect each of the fiducial marks 88 located perpendicularly to the process direction 60. The fiducial mark 94 can also be considered a circumferential line since it is located throughout the belt 22. By adding the fiducial line 94, in combination with the fiducial marks 88, accurate edge registration of the image is provided by allowing for compensation resulting from belt tracking problems such as lateral wobble. In this case, the optical readers 80 would include a linear array of light receptors preferably embodied on an amorphous silicon array. Consequently, whenever the fiducial line 94 moves outside a pre-determined nominal location, the optical reader transmits a signal to the controller 34 such that printing of the image can be compensated. For instance, if the optical reader determines that the belt has moved in the direction perpendicular to the process direction 60 by an amount of 3 pixels, for instance, then the controller would translate the image information a distance of 3 nozzles to compensate.

The present invention also compensates for belt wobble the side to side movement of the belt, by providing a print bar which includes additional nozzles or printhead dies such that the image on the recording medium is complete. For instance, if it is determined that in a typical recording medium 58, the print bars must cover a portion of the recording medium B to complete an image, and if a nominal amount of belt wobble is pre-determined according to various known parameters such as belt composition, tolerance studies or empirical evaluation then the print bars 71, 72, 74, and 76 would include additional nozzles determined as a function of the pre-determined belt wobble to account for the amount of belt wobble. In this way, images are accurately reproduced. For instance, as illustrated in FIG. 3, a printhead die 96, or a portion thereof, and a printhead die 98, or a portion thereof, include nozzles which would not be necessary with a less sophisticated printer.

It is known that ink jet print bars eject satellite drops which are undesirable and which can settle on various parts of the printhead bar. Consequently, a problem may develop with the optical readers 80 being contaminated with contaminants, for instance, stray ink drops or paper fibers. The present invention, therefore, includes the maintenance device 42 which is used to apply a wetting agent, with a wetting nozzle, to the front of the printhead nozzles as well as to the optical reader. In addition, The present system includes a vacuum system, including a vacuum nozzle, to clean the printbar front face and the optical readers. Such a system is described in U.S. patent application Ser. No. 08/566,472 to Anderson et al. entitled "Fluid Applicator For Maintenance of Liquid Ink Printers", assigned to Xerox Corporation, herein incorporated by reference. Furthermore, since the optical readers transmit signals responsive to the transmission of light, the lack of light sensitivity from the readers 80 may be used to indicate that the print bars need cleaning as well. Since the present invention calls for placement of the optical readers in line with the printhead dies, the same maintenance that is used to clean the printhead dies can be used to maintain the readers 80.

The present invention is also useful as an automatic alignment system when the printhead bars are aligned during the manufacturing process. Since the belt 22 is new and has not suffered any distortion from repeated use, the fiducial marks 88 as well as the fiducial line 94 can act as highly accurate positioning markers for alignment of the bars. In this way, the print bar/belt/alignment system is accurately aligned with respect to one another and does not require additional manufacturing alignments which might be required in other systems where the print bar does not include an integral optical reader aligned with the printhead dies.

While this invention has been described in conjunction with a specific embodiment thereof, in an ink jet environment, it is evident that many alternatives, modifications, and variations will be apparent to those skilled in the art. For instance, the present invention is not limited to the embodiments shown, but is applicable to any liquid ink print engine which is used for printing images on recording mediums including copiers. In one practical embodiment of the present invention, the printhead could include not only a sideshooter type of printbar as described but can also include roofshooter types of printbars. Accordingly, it is intended to embrace all such alternatives, modifications and variations that fall within the spirit and broad scope of the appended claims.

What is claimed is:

1. A liquid ink printer, depositing liquid ink to form an image, on a recording medium, including a printing dimension defining a maximum print area to receive the liquid ink, moving along a recording medium path, comprising:

at least one printbar, each printbar including a plurality of nozzles, aligned substantially perpendicular to the recording medium path, to deposit a swath of ink on the recording medium during movement of the recording medium along the recording medium path;

a recording medium transport, disposed adjacent said plurality of nozzles, to move the recording medium along the recording medium path;

a plurality of fiducial marks permanently located on said recording medium transport; and an encoder system, attached to said printbar, to determine a position of said recording medium transport with respect to said array of nozzles.

2. The liquid ink printer of claim 1, wherein said plurality of nozzles includes length sufficient to deposit ink across the entirety of the printing dimension.

3. The liquid ink printer of claim 2, wherein said recording medium transport comprises a belt.

4. The liquid ink printer of claim 3, wherein said fiducial marks are arranged substantially perpendicular to the recording medium path.

5. The liquid ink printer of claim 4, wherein said belt comprises at least a semi-transparent material.

6. The liquid ink printer of claim 4, wherein said plurality of fiducial marks comprise a microwave compatible material.

7. The liquid ink printer of claim 4, wherein said encoder system comprises an optical reader, coupled to said printbar, to sense said plurality of fiducial marks.

8. The liquid ink printer of claim 7, wherein said printbar comprises a mounting substrate, to mount said plurality of nozzles and to mount said optical reader.

9. The liquid ink printer of claim 8, wherein said mounting substrate comprises a substantially planar surface.

10. The liquid ink printer of claim 9, wherein said substantially planar surface varies no more than approximately plus or minus 15 microns.

11. The liquid ink printer of claim 9, wherein said plurality of nozzles comprise a plurality of printhead dies, each of said printhead dies mounted to said substantial planar surface.

12. The liquid ink printer of claim 11, wherein said optical reader comprises a silicon device.

13. The liquid ink printer of claim 12, wherein said silicon device comprises an amorphous silicon array.

14. The liquid ink printer of claim 13, wherein said amorphous silicon array comprises a plurality of light sensing readers.

15. The liquid ink printer of claim 14, wherein said encoder system comprises a light source disposed adjacent to said belt to illuminate said plurality of fiducial marks.

16. The liquid ink printer of claim 14, wherein said belt comprises a fiducial line aligned substantially parallel to the recording medium path.

17. The liquid ink printer of claim 3, wherein said plurality of nozzles comprises an array of nozzles including a nozzle array length determined as a function of a predetermined amount of anticipated belt wobble.

18. The liquid ink printer of claim 17, wherein said array of nozzles comprises a linear array of nozzles.

19. The liquid ink printer of claim 7, further comprises a maintenance system, positionable to a position adjacent said printbar and said sensing device, to clean said array of nozzles and said sensing device.

20. The liquid ink printer of claim 19, wherein said maintenance system includes a wetting device to wet said printbar and said sensing device.

21. The liquid ink printer of claim 20, wherein said maintenance system includes a vacuum device to vacuum said printbar and said sensing device of contaminants.

22. The liquid ink printer of claim 7, comprising a second printbar, including a plurality of nozzles, and a sensing device coupled thereto, to enable a determination of the position of the recording medium along the recording medium path with respect to said first mentioned printbar and said second printbar.

* * * * *